US009511415B2

(12) United States Patent
Nonomura et al.

(10) Patent No.: US 9,511,415 B2
(45) Date of Patent: Dec. 6, 2016

(54) METAL PLATE FORMING METHOD

(71) Applicants: Kiyoshi Nonomura, Nissin (JP); Koji Kurozumi, Obu (JP); Koji Inoue, Aichi-ken (JP); Hiroyuki Horiuchi, Toyota (JP)

(72) Inventors: Kiyoshi Nonomura, Nissin (JP); Koji Kurozumi, Obu (JP); Koji Inoue, Aichi-ken (JP); Hiroyuki Horiuchi, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 217 days.

(21) Appl. No.: 13/832,325

(22) Filed: Mar. 15, 2013

(65) Prior Publication Data

US 2013/0263639 A1 Oct. 10, 2013

(30) Foreign Application Priority Data

Apr. 5, 2012 (JP) ..... 2012-086597

(51) Int. Cl.

| | |
|---|---|
| ***B21J 5/00*** | (2006.01) |
| ***B21D 22/18*** | (2006.01) |
| ***B21D 22/02*** | (2006.01) |
| ***B21D 31/00*** | (2006.01) |

(52) U.S. Cl.
CPC ..... *B21J 5/00* (2013.01); *B21D 22/02* (2013.01); *B21D 22/18* (2013.01); *B21D 31/005* (2013.01)

(58) Field of Classification Search
CPC ..... B21D 31/005; B21D 31/00; B21D 22/16; B21D 22/18; B21D 22/22; B21D 22/26; B21D 22/30; B21D 5/008; B21D 22/02
See application file for complete search history.

(56) References Cited

U.S. PATENT DOCUMENTS

| | | | | |
|---|---|---|---|---|
| 6,197,129 | B1 * | 3/2001 | Zhu | B21C 23/001 148/400 |
| 7,536,892 | B2 * | 5/2009 | Amino et al. | 72/305 |
| 2004/0148997 | A1 * | 8/2004 | Amino et al. | 72/297 |
| 2006/0090530 | A1 | 5/2006 | Hammer et al. | |
| 2006/0272378 | A1 | 12/2006 | Amino et al. | |

FOREIGN PATENT DOCUMENTS

| | | |
|---|---|---|
| JP | 2003-53436 | 2/2003 |
| JP | 2003-245728 | 9/2003 |
| JP | 2007-512960 | 5/2007 |
| JP | 2006-341262 | 12/2008 |
| JP | 2010-214468 | 9/2010 |

* cited by examiner

*Primary Examiner* — Debra Sullivan
(74) *Attorney, Agent, or Firm* — Finnegan, Henderson, Farabow, Garrett & Dunner, LLP

(57) ABSTRACT

A forming method of a metal plate includes press-forming the metal plate with a die, and processing the press-formed metal plate by incremental-forming.

3 Claims, 4 Drawing Sheets

(S110~S130)

(S150)

(S150)

METAL PLATE FORMING METHOD

INCORPORATION BY REFERENCE

The disclosure of Japanese Patent Application No. 2012-086597 filed on Apr. 5, 2012 including the specification, drawings and abstract is incorporated herein by reference in its entirety.

BACKGROUND OF THE INVENTION

1. Field of the Invention

The invention relates to technology of a metal plate forming method.

2. Description of Related Art

Metal plate forming is a process that involves deforming a metal plate (hereinafter, referred to as a "workpiece"), without removing any portion of the metal plate. One well-known workpiece forming method is a press forming process using a die, for example. While press forming is suitable for mass production, manufacturing the die is time consuming and very expensive, and is thus unsuitable for low-volume production.

One known workpiece forming method that is suitable for low-volume production is incremental forming. Incremental forming is a method of forming that involves pressing a rod-shaped tool into a workpiece and stretching the workpiece little by little while moving the rod-shaped tool, without using a die (see Japanese Patent Application Publication No. 2006-341262 (JP 2006-341262 A), for example).

While incremental forming is suitable for manufacturing a wide variety of products in small quantities, when forming a workpiece from a flat plate to the final shape, there are drawbacks, e.g., the required distance of the tool path is long and forming it takes time because the moving speed of the tool is slow, so production efficiency is poor. Therefore, there is a need for a metal plate forming process that is suitable for low-volume production, and enables the forming time to be shortened.

SUMMARY OF THE INVENTION

The invention thus provides a metal plate forming method that is suitable for low-volume production, and enables the forming time to be shortened.

A first aspect of the invention relates to a forming method of a metal plate, which includes press-forming the metal plate with a die, and processing the press-formed metal plate by incremental-forming.

A forming process that restores a shape of the press-formed metal plate to an original shape may be performed in the incremental-forming.

A forming process that eliminates a characteristic line of the formed metal plate may be performed in the incremental-forming.

The incremental forming may be performed in a final step of the forming method.

Thus, the metal plate forming method of the invention is both suitable for low-volume production, and enables the forming time to be shortened,

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
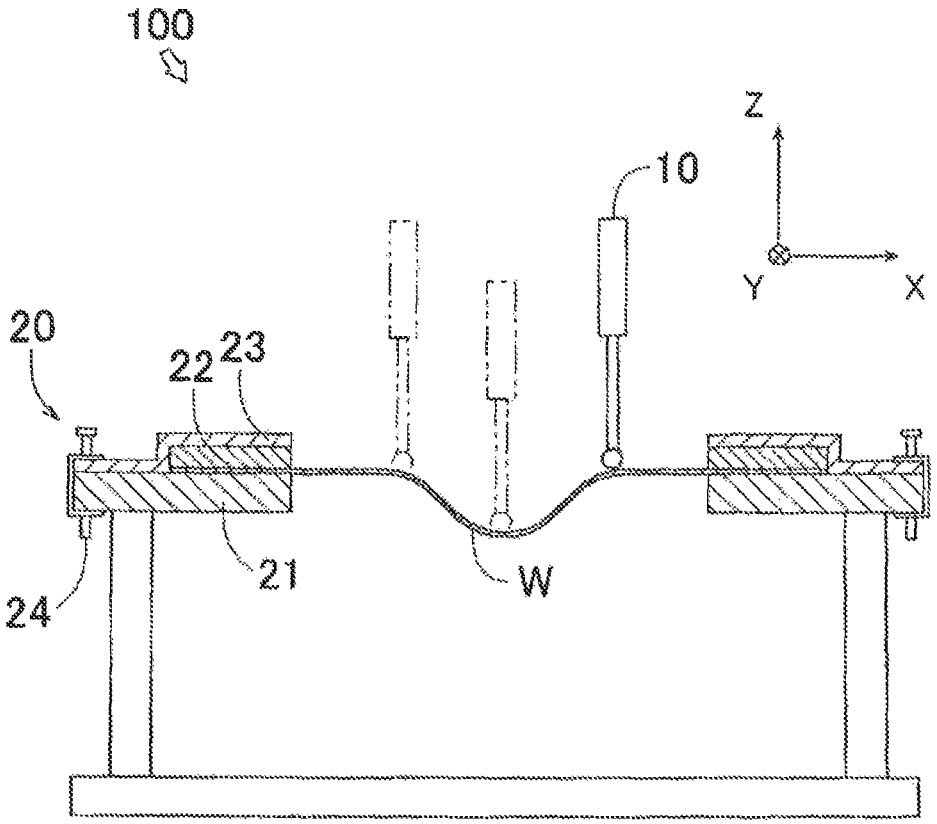
FIG. 1 a block diagram of the general structure of an incremental forming apparatus according to one example embodiment of the invention.

An incremental forming apparatus 100 will now be described with reference to FIG. 1. FIG. 1 is a sectional block diagram of the incremental forming apparatus 100.

First, the structure of the incremental forming apparatus 100 will be described. The incremental forming apparatus 100 presses a rod-shaped tool 10 into a workpiece W, and stretches the workpiece W little by little while moving the rod-shaped tool 10. The incremental forming apparatus 100 includes the rod-shaped tool 10 and a support device 20.

The workpiece W of this example embodiment is a part for a vehicle, which is formed from a metal plate. As will be described later, the workpiece W is formed (i.e., processed) by the incremental forming apparatus 100 in a final stage after being press formed by a press forming apparatus, not shown.

The rod-shaped tool 10 is pressed into the workpiece W, and stretches the workpiece W little by little while the rod-shaped tool 10 moves, The rod-shaped tool 10 is attached to an NC (Numerical Control) machine, not shown. An NC machine is a machining apparatus that operates according to numerical control. With an NC machine, operation of the rod-shaped tool 10 is defined by coordinate values in X, Y, and Z directions, and the workpiece W is formed by operating the rod-shaped tool 10 using a servo motor integrated in a machine tool, based on this information.

The support device 20 supports the workpiece W formed by the rod-shaped tool 10. The support device 20 includes a base. 21, a buffer member 22, a cover plate 23, and a clamping jig 24.

The base 21 is a part on which a portion of the workpiece W that will not be formed (an edge portion of the workpiece W in this example embodiment) is placed, The buffer member 22 is arranged between the cover plate 23 and the workpiece W. The cover plate 23 presses on the portion of the workpiece W that will not be formed. The clamping jig 24 presses the cover plate 23 against the portion of the workpiece W that will not be formed, by clamping the cover plate 23 to the base 21.

Next, operation of the incremental forming apparatus 100 will be described. The portion of the workpiece W that will not be formed is fixedly supported by the support device 20, and the workpiece W is stretched little by little by the rod-shaped tool 10 controlled by an NC machine.

Figure 2:
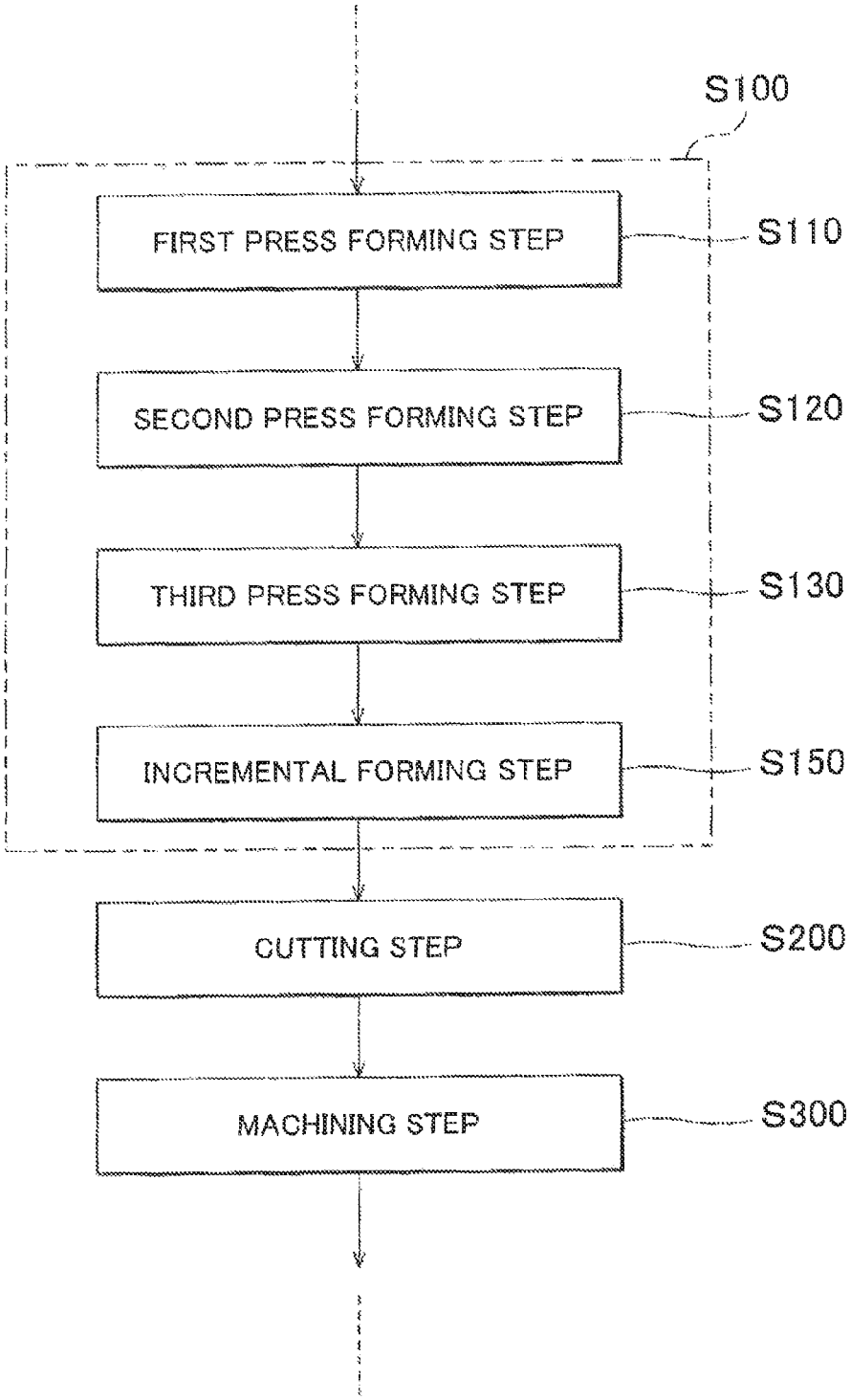
FIG. 2 is a flowchart illustrating the flow of a forming step according to the example embodiment of the invention.

The flow of a forming step S100 will now be described with reference to FIG. 2. FIG. 2 is a flowchart illustrating the flow of the forming step S100.

The forming step S100 is the forming method of the example embodiment of the invention. In the forming step S100, the workpiece W is formed. The forming step S100 includes press forming steps S110 to S130, and an incremental forming step S150. After the forming step S100, a cutting step S200 and a machining step S300 and the like are performed.

In the press forming steps S110, S120, and S130, the workpiece W is press formed by a pair of dies. Press forming includes bending or raising or the like. In this example embodiment, the plurality of press forming steps includes a first press forming step S110, a second press forming step S120, and a third press forming step S130, but is not limited to this.

The incremental forming step S150 is a step for forming the workpiece W with the incremental forming apparatus 100 described above. In the incremental forming step S150, the rod-shaped tool 10 is pressed into the workpiece W, and the workpiece W is stretched little by little while moving the rod-shaped tool 10.

The incremental forming step S150 includes not only a forming process for forming the workpiece W in the desired final shape in the forming step S100, but also a forming process for restoring a shape formed in the plurality of press forming steps S110 to S130 to its original shape (i.e., the shape before forming).

Here, it is worthy to note that the incremental forming step S150 is executed as the final step of the forming step S100, i.e., after all of the press forming steps S110 to S130 are complete.

Figure 3:
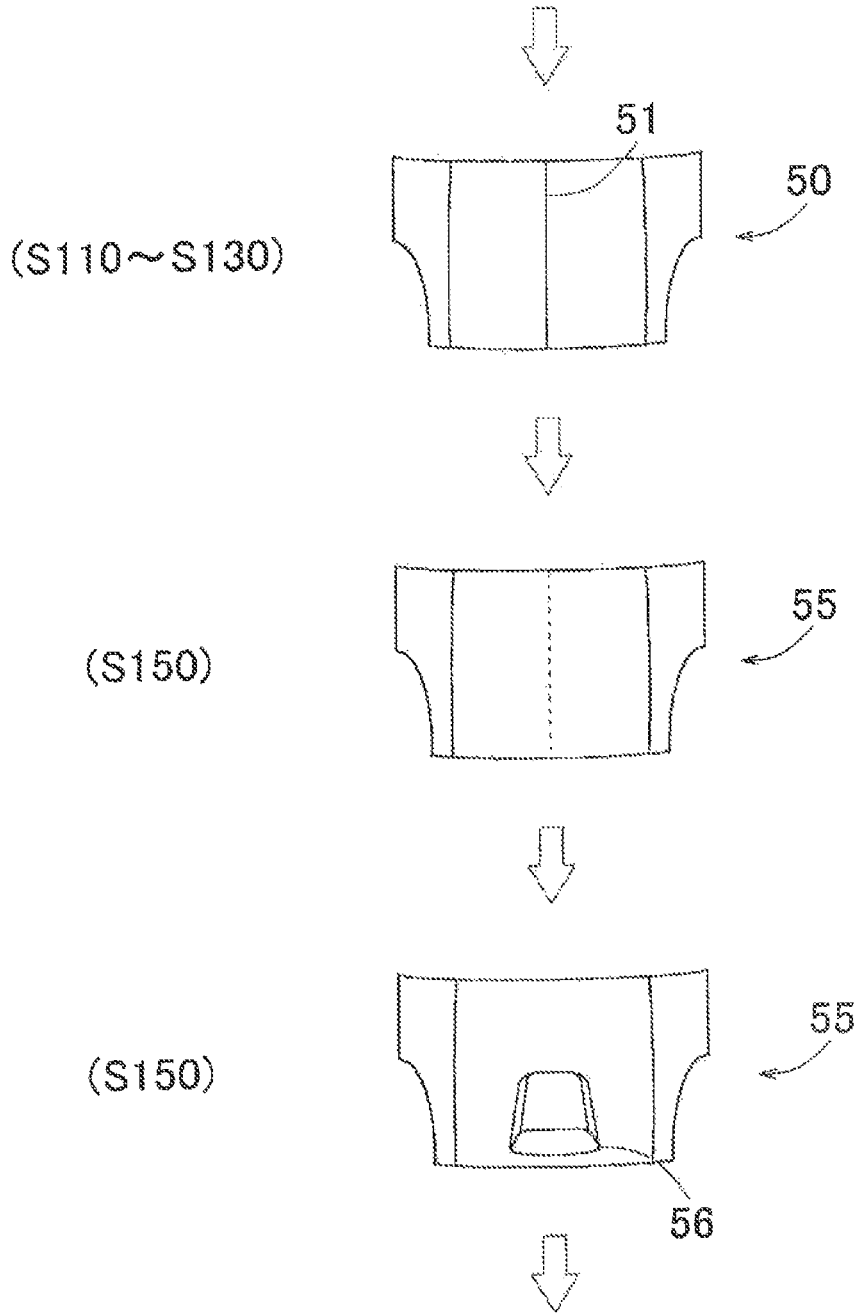
FIG. 3 is a view showing a frame format of the flow of the forming step according to the example embodiment of the invention.

Next, the flow of a forming process of a hood outer according to the forming step S100 will be described with reference to FIG. 3. FIG. 3 is a view showing a frame format of the flow of the forming step S100 for the hood outer.

The hood outer is a member that covers an engine room from above. Here, in the forming step S100, a mass production type hood outer 50 and a small production type hood outer 55 are formed. A characteristic line 51 is formed in a surface center portion of the mass production type hood outer 50, and an air intake 5 is formed in a surface center portion of the small production type hood outer 55.

In the first press forming step S110, the second press forming step S120, and the third press forming step S130, the shape of the mass production type hood outer 50 in the forming step S100 is formed by press forming with a die. The forming process of the mass production type hood outer 50 is finished with the press forming steps S110 to S130.

In the incremental fanning step S150, the small production type hood outer 55 is formed. In the incremental forming step S150, the small production type hood outer 55 is formed based on the mass production type hood outer 50.

In the incremental fanning step S150, the mass production type hood outer 50 is first stretched little by little while moving the rod-shaped tool 10 so as to eliminate the characteristic line 51. That is, the shape formed in the press forming steps S110 to S130 is then eliminated in the incremental forming step S150, thereby restoring the shape of the portion where the characteristic line 51 had been formed to the shape prior to forming.

Then in the incremental forming step S150, the mass production type hood outer 50 from which the characteristic line 51 has been eliminated is stretched little by little while moving the rod-shaped tool 10, thus forming the air intake 56. The forming process of the small production type hood outer 55 is finished with the incremental forming step S150.

Figure 4A:
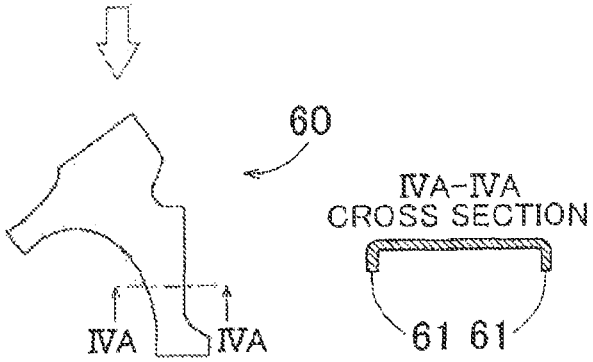
FIGS. 4A to 4C are views showing a frame format of the flow of the forming step for another part.
Figure 4B:
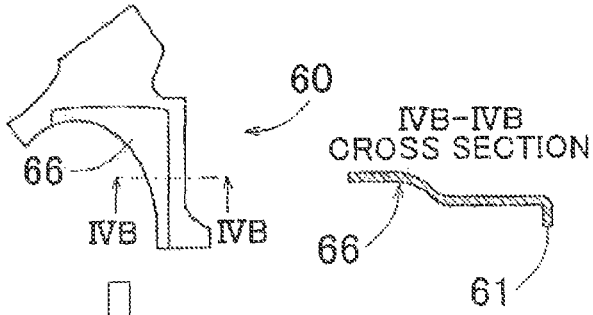
Figure 4C:
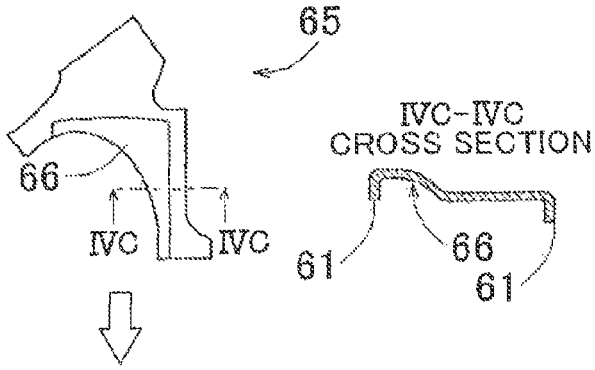

Next, the flow of a forming process for a fender according to the forming step S100 will be described with reference to FIGS. 4A to 4C. FIGS. 4A to 4C are views showing a frame format of the flow of the forming step S100 for the fender.

The fender is a mudguard that is attached surrounding a tire, and is a portion that is integrated with each of the front and rear left and right body panels, Here, in the forming step S100, a production model fender 60 and a small production type fender 65 are formed. An over fender 66 is formed on the small production type fender 65.

In the first press forming step S110, the second press forming step S120, and the third press forming step S130, the shape of the production model fender 60 in the forming step S100 is formed by press fanning with a die. The forming process of the production model fender 60 is finished with the press forming steps S110 to S130.

In the incremental forming step S150, the small production type fender 65 is formed, In the incremental forming step S150, the small production type fender 65 is formed based on the production model fender 60.

In the incremental forming step S150, first a flange 61 on one side of the production model fender 60 is stretched little by little while moving the rod-shaped tool 10, and restored to its original shape (i.e., the shape before forming). That is, the shape fanned in the press forming steps S110 to S130 is restored to its original shape again by the forming process in the incremental forming step S150.

In the incremental forming step S150, the production model fender 60 from which the flange 61 has been eliminated is stretched little by little while moving the rod-shaped tool 10, thus forming the over fender 66.

Next, in the incremental forming step S150, the production model fender 60 on which the over fender 66 is formed is stretched little by little while moving the rod-shaped tool 10, thus forming the flange 61. The forming process of the small production type fender 65 is finished with the incremental forming step S150.

Now the effects of the forming step S100 will be described. This forming step S100 is suitable for low-volume production, and enables the forming time to be shortened.

That is, in the forming step S100, a shape of a production model workpiece W, together with a common shape of the shape of the production model workpiece W and a shape of a small production type workpiece W, are formed in the press forming steps S110 to S130 with a die, Then the specific shape of the small production type workpiece W is formed in the incremental forming step S150. Therefore, forming in the incremental forming step S150 where forming is time consuming is minimized, so forming can be performed efficiently.

Also, by restoring the shape formed in the press forming steps S110 to S130 to the original shape, in the incremental forming step S150, the general applicability of the workpiece W formed by the forming step S100 of which the incremental forming step S150 is the final step is able to be improved.

What is claimed is:

1. A metal plate forming method, comprising:

press-forming a metal plate with a die such that a shape of a portion constituting less than all of the press-formed metal plate is changed as compared to an original shape of the portion prior to the press-forming; and incremental-forming the press-formed metal plate, wherein the incremental-forming includes:

pressing a rod-shaped tool into the press-formed metal plate and stretching the press-formed metal plate little by little while moving the rod-shaped tool, such that the shape of the portion of the pressed-formed metal plate is restored to the original shape of the portion.

2. The forming method according to claim 1, wherein the incremental-forming is performed in a final step of the forming method.

3. The forming method according to claim 1, wherein the shape of the portion of the pressed-formed metal plate includes a characteristic line, and the characteristic line is eliminated in the incremental-forming.

* * * * *